US005247820A

United States Patent [19]

Panaccione

[11] Patent Number: 5,247,820

[45] Date of Patent: Sep. 28, 1993

[54] COMBINATION COBBLE COVER AND GUIDE TROUGH FOR ROLLING MILL

[75] Inventor: Louis T. Panaccione, Barre, Mass.

[73] Assignee: Morgan Construction Company, Worcester, Mass.

[21] Appl. No.: 990,674

[22] Filed: Dec. 14, 1992

[51] Int. Cl.[5] ..... B21B 39/14

[52] U.S. Cl. ..... 72/250; 72/428; 226/199; 198/600

[58] Field of Search ..... 72/234, 235, 238, 239, 72/250, 251, 428; 226/196, 199; 198/600, 860.3, 860.5, 860.5, 861.3, 861.5

[56] References Cited

U.S. PATENT DOCUMENTS

| | | | |
|---|---|---|---|
| 268,259 | 11/1882 | McDonald | 72/200 |
| 3,798,952 | 3/1974 | Easter | 72/250 |
| 4,555,923 | 12/1985 | Reth et al. | 72/250 |

*Primary Examiner*—Lowell A. Larson
*Assistant Examiner*—Thomas C. Schoeffler
*Attorney, Agent, or Firm*—Samuels, Gauthier & Stevens

[57] ABSTRACT

A rolling mill has a roll stand with work rolls defining a roll pass. The roll stand is removably mounted at an operative position at which its roll pass is aligned with the mill rolling line. A cover assembly is configured and dimensioned to cooperate in a closed position with roll stand to enclose the work rolls. A guide trough is integrally associated with the cover assembly. The cover assembly is alternatively adjustable from its closed position to either an open position allowing access to the work rolls when the rolls stand is in its operative position, or to a guide position at which the guide trough is aligned with the mill rolling line when the roll stand is removed from its operative position.

9 Claims, 5 Drawing Sheets

COMBINATION COBBLE COVER AND GUIDE TROUGH FOR ROLLING MILL

BACKGROUND OF THE INVENTION

1. Field Of The Invention

This invention relates generally to rod and bar rolling mills, and is concerned in particular with an improvement in guide troughs of the type employed to replace roll stands when they are removed from the rolling line.

2. Description of the Prior Art

Conventionally, when a roll stand is removed from the rolling line, it is replaced by a guide trough so that the rolling process may continue. The guide troughs are normally kept in a storage area remote from the rolling line, and must be transported by overhead cranes to the rolling line where they are manually clamped into position. This procedure is time consuming and requires the attention of several operating personnel in addition to the crane operator.

An objective of the present invention is to facilitate the task of locating and removing guide troughs in a rolling mill. Related objectives of the present invention include reducing the time required to manipulate the guide troughs into and out of position, thereby reducing costly mill down time.

A further objective of the present invention is to provide means for manipulating guide troughs without requiring the attention of numerous operating personnel, and without requiring the use of overhead cranes and other auxiliary equipment.

SUMMARY OF THE INVENTION

These and other objects and advantages of the present invention are realized by integrally incorporating the guide troughs into the cover assemblies normally employed along the rolling line to enclose the work rolls and thereby safeguard operating personnel from cobble-related mishaps. The cover assemblies are mounted for adjustable movement from their normal closed positions either to open positions allowing access to the work rolls when the roll stands remain operatively positioned along the rolling line, or alternatively to guide positions at which the troughs are aligned with the rolling line when the roll stands are removed therefrom. Adjustment of the cover assemblies between their multiple operative positions is achieved by powered operating mechanisms, without requiring the assistance of overhead cranes or the like.

BRIEF DESCRIPTION OF THE DRAWINGS

The present invention will become more apparent as the description proceeds with reference to the accompanying drawings, wherein.

DESCRIPTION OF ILLUSTRATED EMBODIMENT

Figure 1:
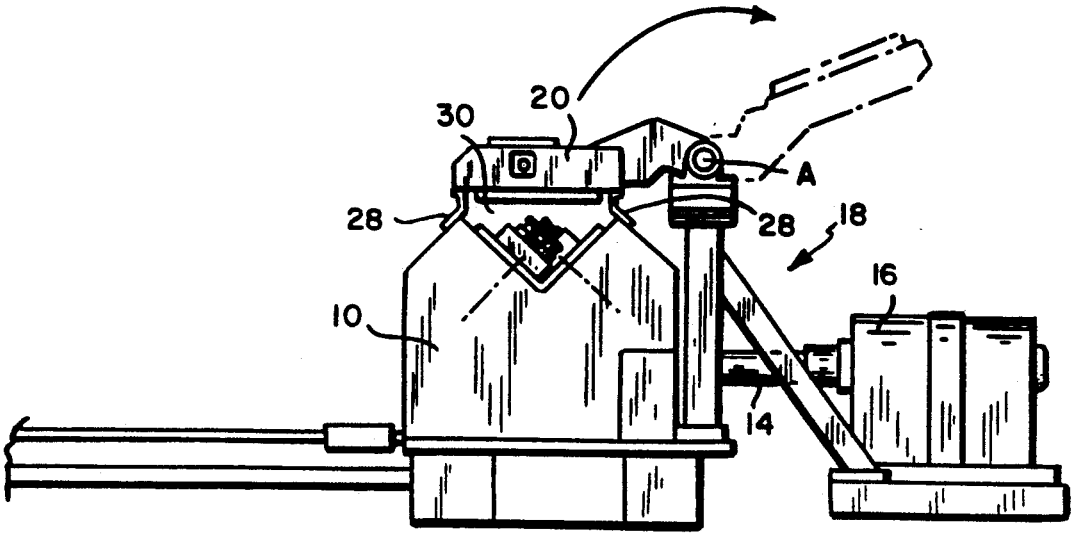
FIG. 1 shows a roll stand operatively positioned with its roll pass aligned with the rolling line, and with the cover assembly in a closed position.
Figure 3:
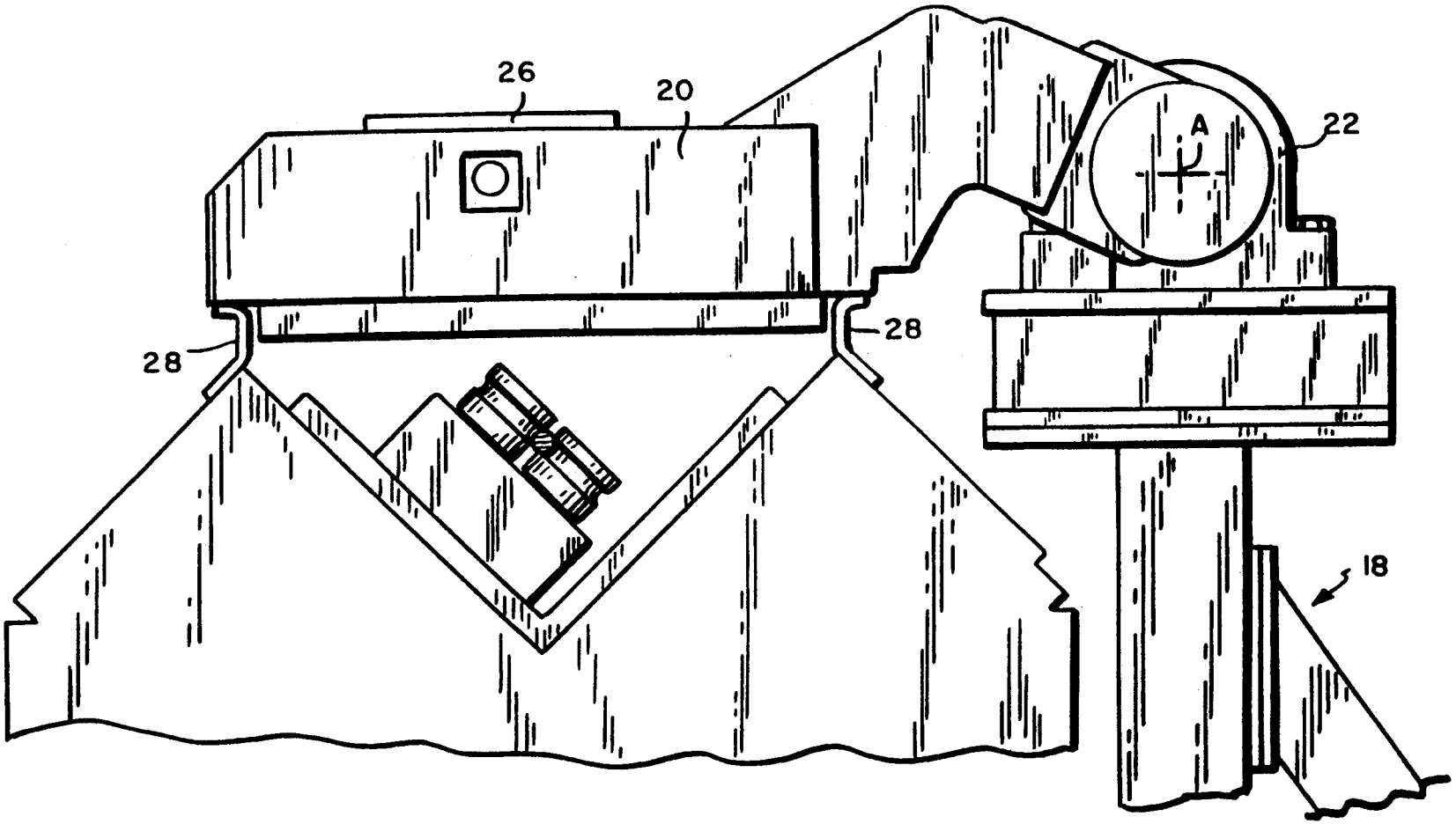
FIG. 3 is a partial view similar to FIG. 1 on an enlarged scale showing further details of the cover assembly.

With reference initially to FIGS. 1 and 3, a roll stand 10 is shown operatively positioned with the roll pass defined by its work rolls 12 aligned with the rolling line P. The operatively positioned roll stand is mechanically coupled via a spindle 14 to a mill drive motor 16.

A carrier structure generally indicated at 18 is located adjacent to the rolling line P. A cover assembly 20 is supported on the carrier structure independently of the roll stand for rotational movement about an axis A extending in parallel relationship to the mill rolling line P. As can best seen by further reference to FIG. 4, the cover assembly is subdivided into multiple sections $20_a$, $20_b$, each being rotatably adjustable about axis A by means of a rotary actuator 22.

A guide trough 24 is located within and integrally associated with each cover assembly segment $20_a$, $20_b$. The guide troughs are of a known design, and are accessible via lids 26 in the roof of each cover assembly segment. When the lids are open, the guide troughs may be serviced, and/or removed for replacement by differently sized components configured to handle differently sized products.

Figure 4:
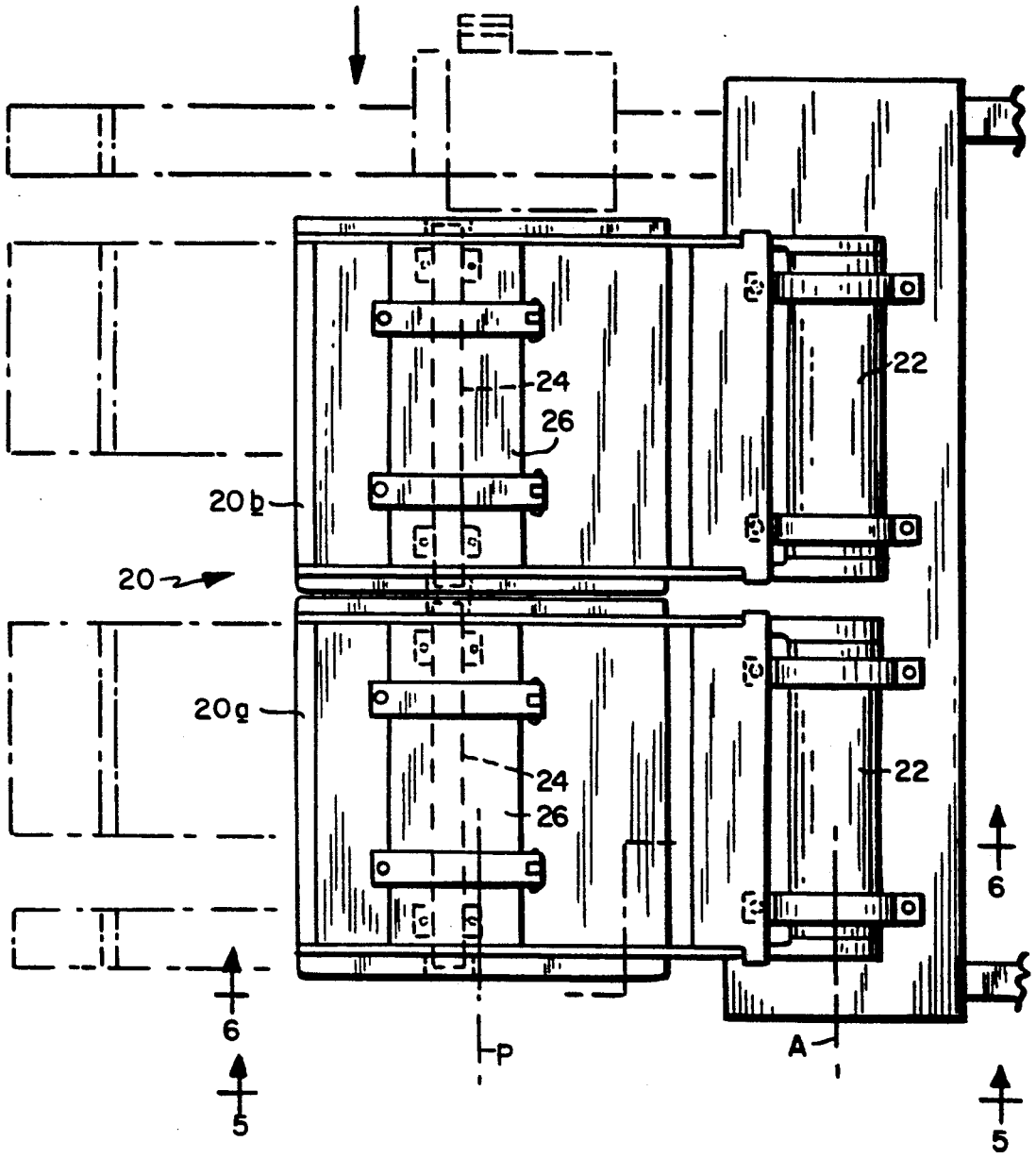
FIG. 4 is a top plan view of the components shown in FIG. 3.

When in the closed position as illustrated in FIGS. 1, 3 and 4, the cover assembly rests on parallel support flanges 28 forming part of the roll stand 10. The closed cover assembly cooperates with the underlying roll stand to confine the work rolls 12 within an enclosed space 30, thereby safeguarding operating personnel from cobble-related mishaps. When the cover assembly is in the closed positioned, its integrally associated guide troughs 24 are inoperatively located above the rolling line P.

Figure 5:
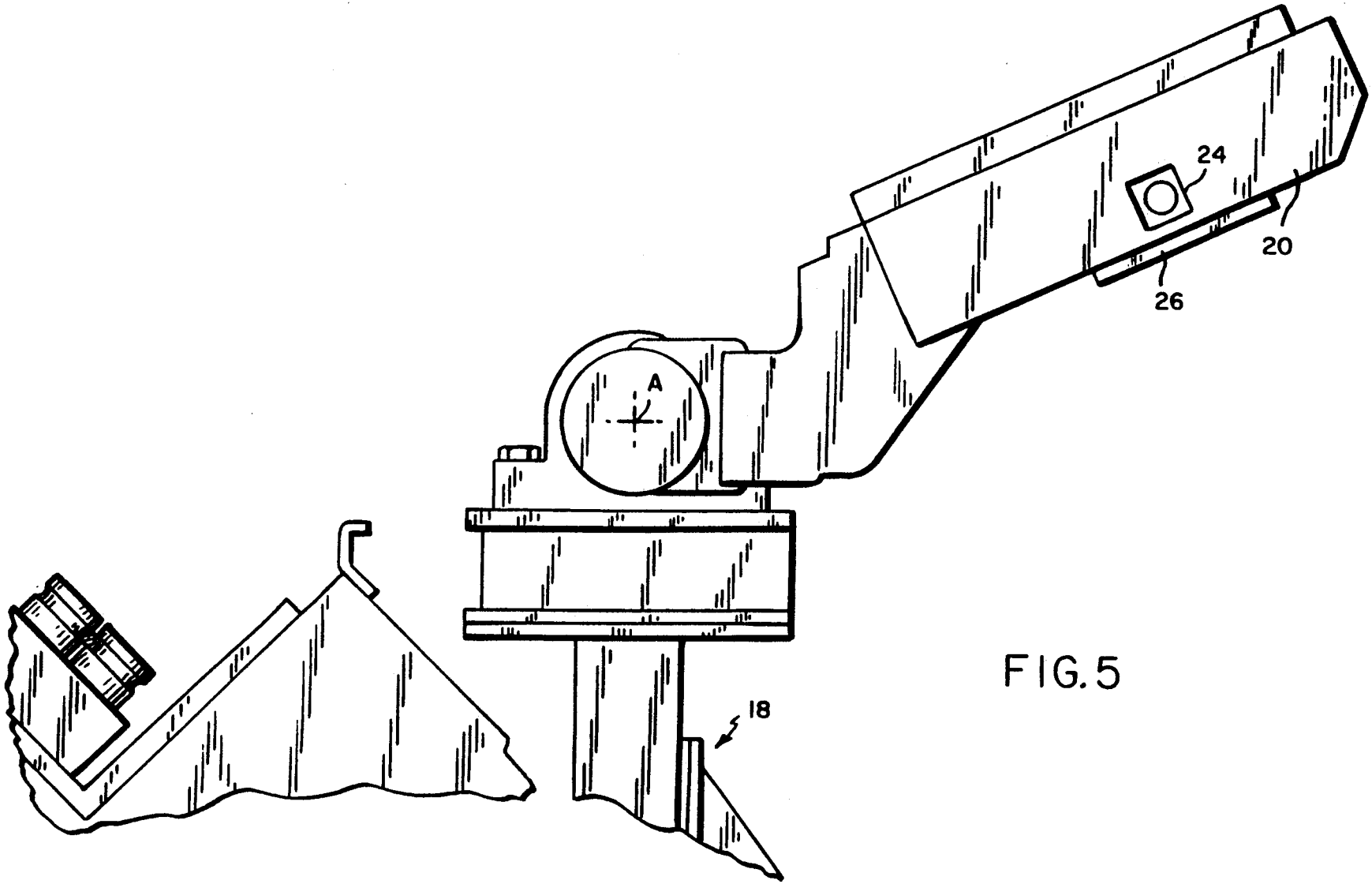
FIG. 5 is a view taken along lines 5—5 of FIG. 4 and showing the cover assembly in the open position.

When access to the work rolls is required, for example when work rolls must be replaced, the rotary actuators 22 are energized to swing the cover assembly segments upwardly to the fully opened position illustrated by the broken lines in FIG. 1 and illustrated in further detail in FIG. 5.

Figure 2:
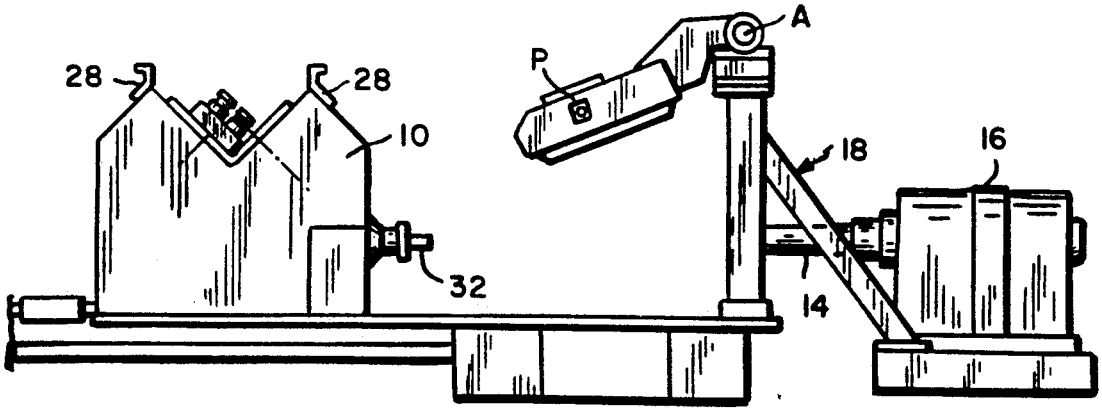
FIG. 2 is a view similar to FIG. 1 showing the roll stand removed from the rolling line, with the cover assembly adjusted to the guide position.
Figure 6:
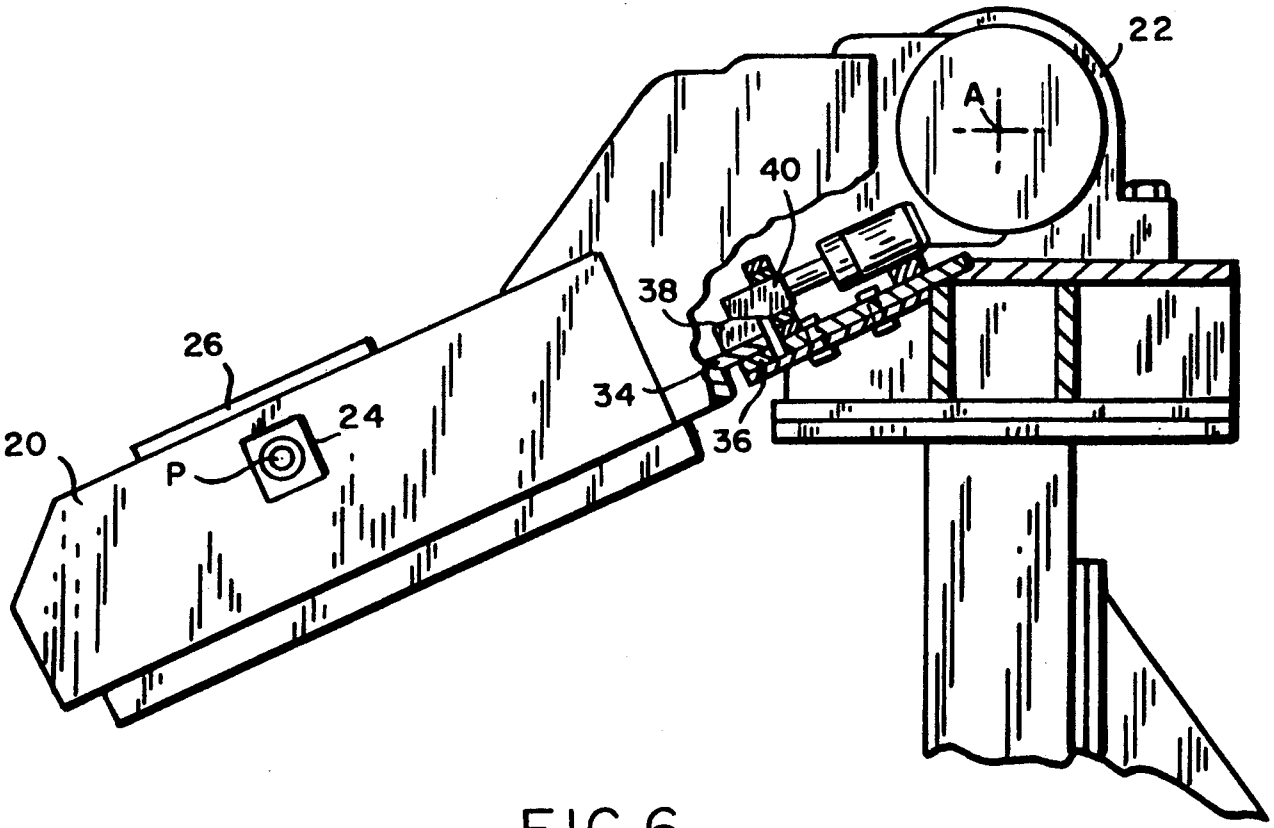
FIG. 6 is a sectional view taken along line 6—6 of FIG. 4 and showing the cover assembly in the guide position.

When removing a roll stand from the rolling line, a procedure commonly referred to as "dummying", the cover assembly segments are first rotated to their fully opened positions. An appropriate transfer mechanism 31 is then utilized to shift the roll stand away from the rolling line to an inoperative position as shown for example in FIG. 2. During this procedure, a stub shaft 32 on the roll stand is simply decoupled from the spindle 14, the latter remaining in place. Thereafter, the cover assembly segments are rotated to the guide positions shown in FIG. 2, and in greater detail in FIG. 6. When thus positioned, the guide troughs 24 of the cover assembly segments are aligned with the rolling line P. Arms 34 on the cover assembly segments rest on stops 36 on the carrier structure. The arms 34 include inclined ramps 38 which are engaged by piston-actuated wedges 40 employed to securely lock the cover assembly segments in place.

In light of the foregoing, it will now be appreciated by those skilled in the art that by integrally incorporating guide troughs into cover assemblies which are rotatably adjustable with respect to the rolling line, significant advantages are obtained. The guide troughs may quickly and reliably be positioned in place of dummied roll stands without having to resort to overhead cranes and the like. The cover assemblies and their integral guide troughs thus serve multiple functions, each of which can be selected with minimal effort on the part of operating personnel.

I claim:

1. In a rolling mill having a roll stand with work rolls defining a roll pass, said roll stand being removably mounted at an operative position at which said roll pass is aligned with a mill pass line, the improvement comprising:

a cover assembly configured and dimensioned to cooperate in a closed position with said roll stand to enclose said work rolls;

a guide trough integrally associated with said cover assembly;

a carrier structure for supporting said cover assembly independently of said roll stand; and adjustment means associated with said carrier structure for alternatively moving said cover assembly from said closed position to either an open position allowing access to said work rolls when said roll stand is in said operative position, or to a guide position at which said guide trough is aligned with said mill pass line when said roll stand is removed from said operative position.

2. The apparatus as claimed in claim 1 wherein said cover assembly is rotatably mounted on said carrier structure for movement between said positions.

3. The apparatus as claimed in claim 2 wherein said cover assembly is rotatable about an axis parallel to said mill pass line.

4. The apparatus as claimed in claim 3 wherein said guide trough comprises as a plurality of guide elements extending in parallel relationship with said axis.

5. The apparatus as claimed in claim 1 wherein said guide trough extends through and is removably mounted within said cover assembly, and wherein said cover assembly is provided with means for providing access to said guide trough.

6. The apparatus as claimed in claim 1 wherein said cover assembly is supported by said roll stand when in said closed position.

7. The apparatus as claimed in claim 1 wherein said carrier structure is fixed in relation to said mill pass line and free standing with respect to said roll stand.

8. The apparatus as claimed in claim 1 further comprising stop means on said carrier structure for locating said cover assembly in said guide position.

9. The apparatus as claimed in claim 8 further comprising clamp means for releasably urging said cover assembly against said stop means.

* * * * *